US005184485A

United States Patent [19]

Bini

[11] Patent Number: 5,184,485

[45] Date of Patent: Feb. 9, 1993

[54] CIRCULAR KNITTING MACHINE FOR PRODUCING SPORTS HOSIERY OF FLOATED PATTERN

[75] Inventor: Franco Bini, Florence, Italy

[73] Assignee: Savio S.p.A., Pordenone, Italy

[21] Appl. No.: 680,396

[22] Filed: Apr. 4, 1991

[30] Foreign Application Priority Data

Apr. 6, 1990 [IT] Italy ..... 19969 A/90

[51] Int. Cl.[5] ..... D04B 9/36; D04B 15/68

[52] U.S. Cl. ..... 66/222; 66/216; 66/57

[58] Field of Search ..... 66/57, 221, 222, 224, 66/216

[56] References Cited

U.S. PATENT DOCUMENTS

| | | | |
|---|---|---|---|
| 3,192,742 | 7/1965 | Haddad | 66/57 |
| 3,310,962 | 3/1967 | Mahler et al. | 66/57 |
| 3,405,542 | 10/1968 | Belkenstein | 66/57 |
| 3,726,110 | 4/1973 | Conti | 66/57 X |
| 4,236,389 | 12/1980 | Chietti | 66/222 X |
| 4,328,686 | 5/1982 | Barbee et al. | 66/224 |
| 4,709,563 | 12/1987 | Camiciotti et al. | 66/222 |
| 4,879,884 | 11/1989 | Bertagnoli | 66/222 X |

FOREIGN PATENT DOCUMENTS

| | | | |
|---|---|---|---|
| 2643185 | 9/1976 | Denmark . | |
| 716592 | 12/1941 | Fed. Rep. of Germany | 66/57 |
| 1223982 | 9/1966 | Fed. Rep. of Germany | 66/222 |
| 2816739 | 11/1978 | Fed. Rep. of Germany | 66/57 |
| 3312765 | 4/1983 | Fed. Rep. of Germany . | |
| 2107654 | 4/1972 | France . | |

*Primary Examiner*—Andrew M. Falik
*Assistant Examiner*—John J. Calvert
*Attorney, Agent, or Firm*—George P. Hoare, Jr.

[57] ABSTRACT

A circular knitting machine for floated pattern hosiery with false rib stitches in which the courses of floated pattern knitting are produced in a single knitting position by radially withdrawing in the pattern yarn feed stations the knitting cams and the raising cams, so causing those needles which have received the pattern yarns to pass to an intermediate level until the station in which the basic yarn is fed. These cams then return to operation for the production of the foot in multi-feed plain knitting.

9 Claims, 2 Drawing Sheets

360°0'0"
0°0'0"
FEED 5
64°
BASE YARN
TRANSPARENT YARN
FEED 1
139°
ELASTIC YARN
FEED 2
199°
FEED 3
274°
FEED 4
349°0'0"

CIRCULAR KNITTING MACHINE FOR PRODUCING SPORTS HOSIERY OF FLOATED PATTERN

BACKGROUND OF THE INVENTION

1. Field of the Invention

This invention relates to circular knitting machines, and in particular circular knitting machines for producing sports hosiery.

It defines the movement of the needles to form floated pattern knitting with pattern inserts of different yarns, for example of different colour, and a transparent yarn which is worked with all the needles.

2. Description of the Related Art

In general, circular knitting machines consist essentially of one or more rotating cylinders with tricks in their outer cylindrical surface. The tricks represent the guides for the needles, which during their vertical travel form the stitch loops in cooperation with the sinkers.

The basic knitting formation procedure will be described with reference to FIG. 1.

The cylinder is indicated by 1 and a trick by 2. The number of tricks is equal to the number of needles 3, which slide in their interior with vertical reciprocating motion.

Generally for sports hosiery the number of tricks and needles is between 60 and 120 per cylinder.

The needles 3 operate with reciprocating movement between a position of maximum travel and a position of minimum travel, intermediate levels also being possible.

The cylinder is rotated and with it there rotate the needles which during their reciprocating movement are fed with yarn in fixed angular positions when in their highest point of travel by yarn feed stations which present the needles with that yarn which is to be knitted in that determined knitting course and in that position.

When the needle is raised to its maximum level to receive the new feed yarn, that yarn loop which is retained in its hook opens the needle latch and moves onto its shaft, so that the loop is cleared from the needle as soon as the needle falls to a lower level. To produce hosiery articles generally only part of the available needles are used at the same time and in the same manner, except for the plain knitwork parts, for which all the needles are operated between their maximum and minimum level, all being fed with yarn at each knitting course and all being moved in the same manner.

When the machine is not producing plain knitwork, in order to produce other types of knitwork some needles are required to produce stitch loops while others have to be raised to an intermediate level to take up yarn without clearing the previous stitch in order to form a tuck stitch. Others have to be inactivated by the needle selection members and kept low, i.e. excluded from operation. Finally, others have to form the floated pattern by being raised to take up the yarn and then lowered to just a slightly lower level and then kept at this level without undergoing travel, i.e. without forming stitch loops with said yarn, until the angular position is reached in which they are required to produce stitch loops to form the floated pattern.

The needles are activated or inactivated by a series of lifting cams 4 and lowering cams 5 which act on the jacks 6 located below the needles, and in particular on their lower butt 7 and upper butt 8 respectively whenever the needle raising cams identified hereafter as 21 are extracted from their working position. If a jack 6 remains low and is not engaged by the lifting cams its needle does not participate in the stitch formation cycle until its jack raises it.

When the jacks have moved the needle into its working position, they separate from the needle butt 9 and return downwards by the effect of a lowering cam 5.

When the needle has completed its yarn take-up function and has formed its stitch loop and is therefore at its minimum level, if it does not have to take up new yarn at the next feed it remains at this level because its control jack is in its rest position and does not raise it, provided the needle raising cams are extracted. The jack is selected in the known art by members which displace it radially, for example by making contact with one of the intermediate pattern butts 10, so that it either engages or does not engage the profile of its lifting cam, the selection being done either mechanically or electromagnetically by one of a large number of methods.

With traditional mechanical selection, a certain number of butts 10 are removed from each jack, to leave only one or two which are intended to make contact with the selectors located at their level and to inactivate that jack the butts of which interfere with them.

SUMMARY OF THE INVENTION

The device is generally directed to a circular knitting machine having a plurality of feed station and a plurality of needles for forming stitch loops. The machine comprises knitting cams operatively associated with the machine for lowering the needles to a minimum lower position and counter cams for preventing the needles lowered by the knitting cams from lowering below the minimum lower position. The machine further comprises fixed cams for guiding the needles to a predetermined intermediate position and raising cams for raising the needles to a predetermined upper position. Both the knitting cams and the raising cams are adapted to move radially with respect to the machine for disassociating from needle engagement.

BRIEF DESCRIPTION OF THE DRAWINGS

The following drawings are illustrative of embodiments of the invention and are not intended to limit the invention as encompassed by the claims forming part of the application.

FIG. 3*a* is a schematic representation of the circular knitting machine of the present invention showing the positioning of the feed stations and needles for producing a false rib cuff.

FIG. 3*a'* is a schematic representation of the circular knitting machine of the present invention showing the positioning of the feed stations and needles for producing a false rib cuff.

FIG. 3*b* is a schematic representation of the circular knitting machine of the present invention showing the positioning of the feed stations and needles for producing a patterned plain leg stitch.

FIG. 3*c* is a schematic representation of the circular knitting machine of the present invention showing the positioning of the feed stations and needles for producing a heel, foot, and toe.

DESCRIPTION OF THE PREFERRED EMBODIMENT

Figure 1:
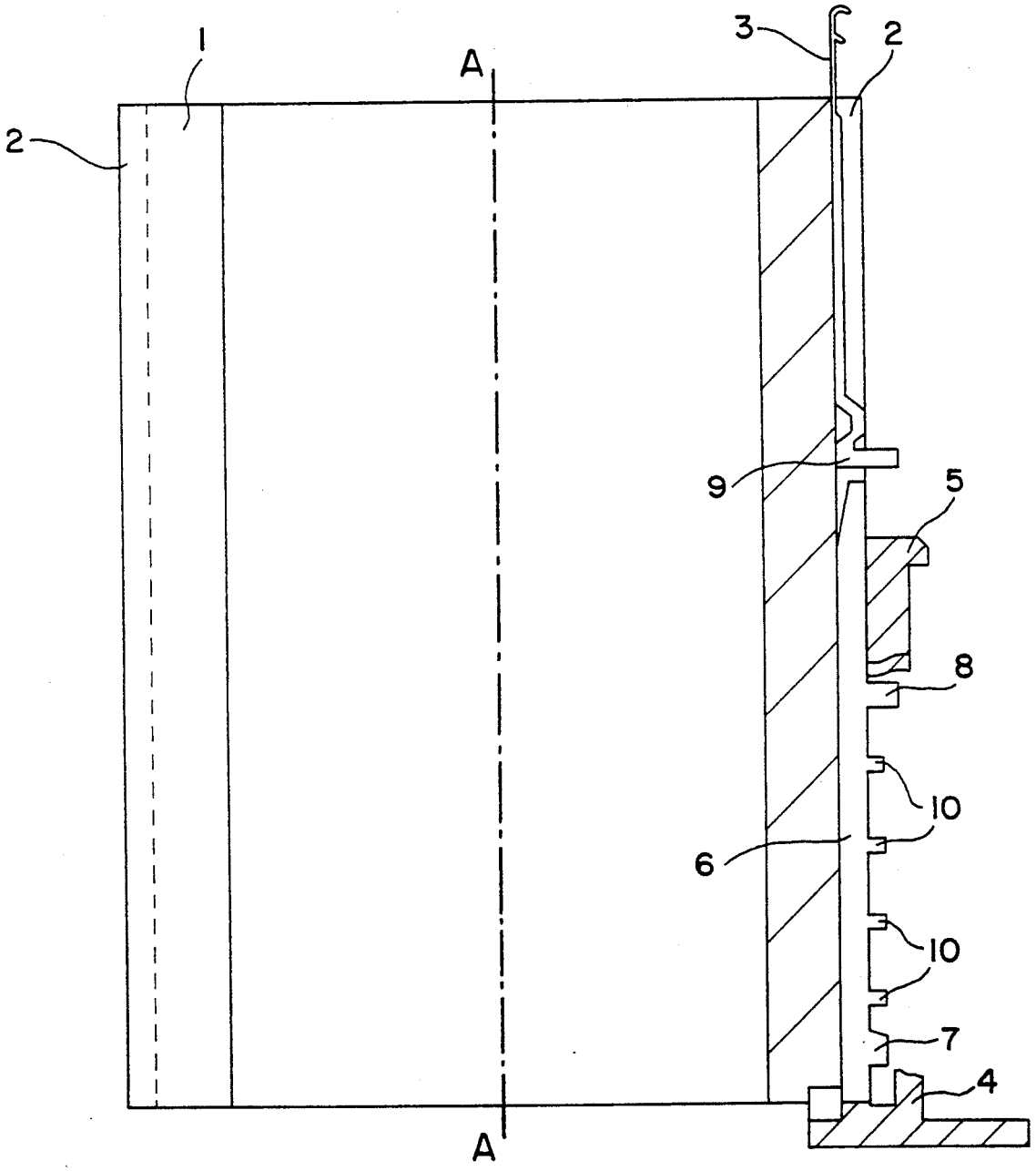
FIG. 1 PRIOR ART
FIG. 1 is a cross section of a circular knitting machine as known in the prior art.
Figure 2:
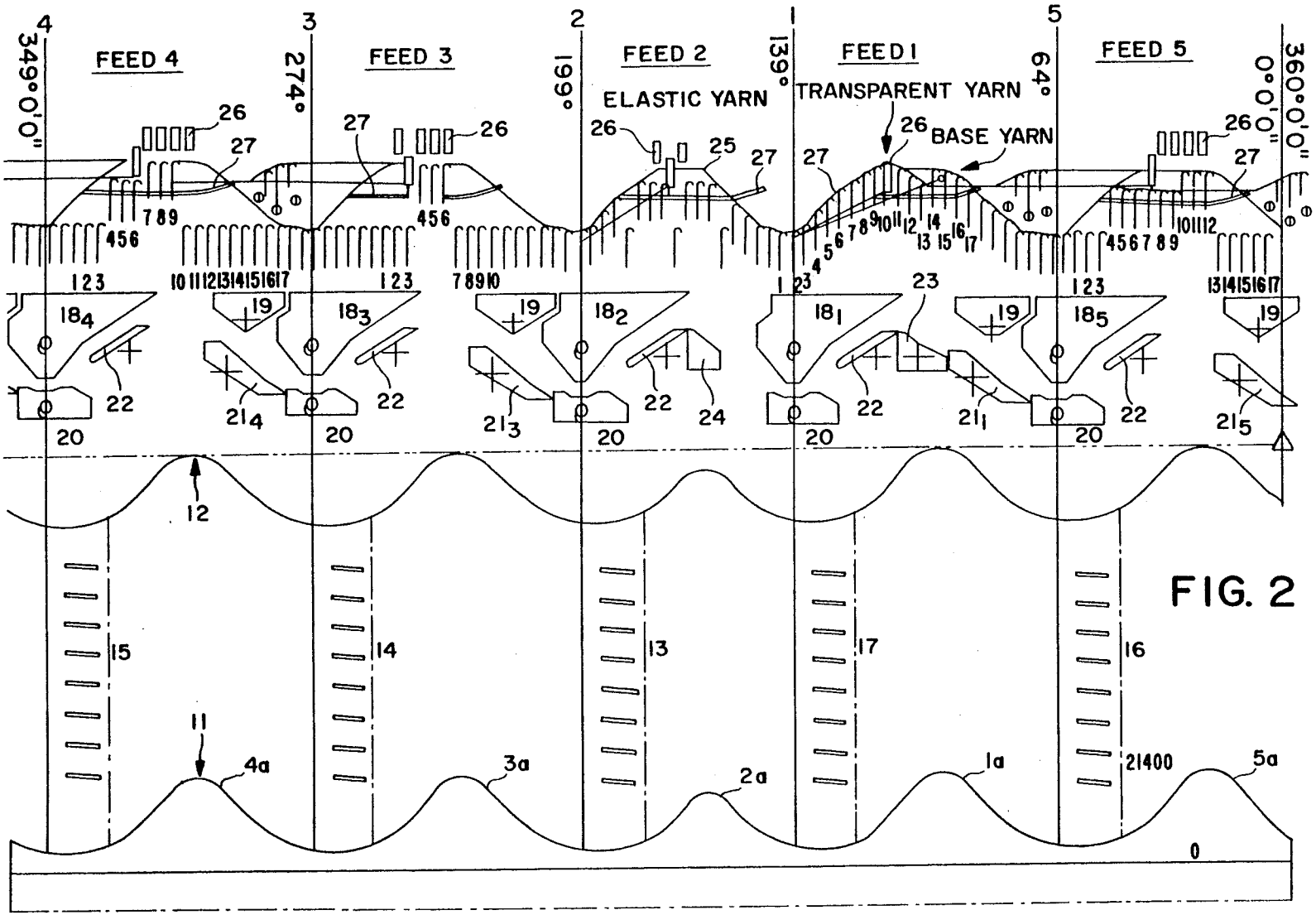
FIG. 2 is a schematic representation of the circular knitting machine of the present invention showing the angular distribution of five feed stations.

The needle activated by its jack is moved by a series of overlying cams which engage the needle butt 9 to thus determine its level. The invention is described with reference to FIGS. 2 and 3*a*, 3*a'*, 3*b*, 3*c* which show a typical embodiment thereof by way of non-limiting example. The machine of the illustrated embodiment is provided with five feeds, i.e. is able to produce five knitting courses for each cylinder revolution, and is consequently provided with five ramps for raising and lowering the jacks and their needles, defined by the cams 4 and 5 of FIG. 1, which determine the paths 11 of the lower butts and the paths 12 of the upper butts of the jacks. The feed stations are located in the central region of each jack and needle raising and lowering ramp at a position corresponding with the highest point of travel of the needle hooks. According to the present invention, the average slope of the rising and descending parts of the ramps is kept constant and the length of the upper horizontal portion of the path of the needle hooks is varied in accordance with the desired number of yarn-type options for each feed. In the embodiment of FIG. 2 the ramps are numbered in boldface as 1*a*, 2*a*, 3*a*, 4*a* and 5*a* at their ends, with the feeds located in their central part. In the elevated horizontal portion of the second ramp only three yarn options are possible, namely the basic yarn, the elastic thread and a third yarn. This ramp is typically intended for the elastic thread feed and when the elastic thread is to be fed has its upper portion situated at a level slightly lower than the upper portions of the other ramps, as it is for tuck stitch operation.

In contrast, the other ramps have an elevated horizontal portion such that five yarn feeds with corresponding yarn guides can be located, giving five yarn options of which one is in any event the basic yarn.

These four ramps have a greater angular extension than the second ramp.

In FIG. 2 the angular distribution of the five feed stations is shown by way of non-limiting example.

The needle selection is effected via the jacks by the actuators of selection devices 13, 14, 15, 16 and 17 along the final low portion of each ramp.

The needles move from right to left.

The path of the needles activated by the jack selection is controlled by:

knitting cams $\mathbf{18}_1$, $\mathbf{18}_2$, $\mathbf{18}_3$, $\mathbf{18}_4$ and $\mathbf{18}_5$; the cams $\mathbf{18}_2$, $\mathbf{18}_3$, $\mathbf{18}_4$ and $\mathbf{18}_5$ are radially extractable so as not to be involved in the control of the needle travel, cams 19 fixed downstream of the cams 18, except for the cam $\mathbf{18}_1$ which is not provided with one. When the cams 18 are extracted radially, the butts 9 of the needles 3 no longer encounter the profile of their lowering cam 18, but only, and somewhat later, the cam 19 which lowers them only partially to cause the needle to undergo only partial travel, fixed counter-cams 20 to counteract the cams 18. According to a preferred embodiment of the present invention the cams 18 and counter-cams 20 associated therewith are mounted mutually rigid to ensure that they remain at an exact distance apart even when they are moved periodically to cause the formation of the various types of stitch. This rigorous maintaining of an exact distance apart prevents the needles breaking when operating at maximum speed, guarantees good quality of the knitwork produced, and ensures that the needle butts pass with a clearance contained within a few hundredths of a millimetre, needle raising cams $\mathbf{21}_1$, $\mathbf{21}_3$, $\mathbf{21}_4$ and $\mathbf{21}_5$, which when in their working position cause the activated needles to rise at the next ramp as far as the tuck stitch level without the intervention of the jacks 6, descent cams 22, all extractable, which operate to form terry knitwork in the pocket heel, in the first feed position, a cam 23 which divides the needles so that they rise in two different points, to take up one or two consecutive yarns at that feed, in the second feed position, an extractable cam 24 which is inserted when the second ramp is also required to move the needles to the same level as the other ramps, to compensate for the smaller rise of the jacks by the cams 4 in that angular section. In this case the upper dashed-line horizontal portion 25 of this ramp is much shorter than the others and for this reason can only comprise a smaller number of feed options.

The feed stations consist of a plurality of yarn guides 26 which are caused to alternately present the yarn required for the work in progress.

A blade 27 is provided at said yarn guides to keep the needle latches in their open position when the raised needles pass in front of the yarn guides 26 in order to grasp the yarn.

When producing plain knitwork, all the needle control cams are in a position close to the cylinder and all operate in the same manner.

When floated patterns are to be worked the machine is set in the configuration described below.

It will be assumed by way of example that a man's sports sock with a floated pattern is to be produced, composed of:

a) a false rib elastic top band, or alternatively a') a patterned false rib elastic top band, b) a leg portion of plain knitting or false ribbing with or without multi-colour patterns in the same knitting course, c) a pocket heel with partially cut knitting courses alternating with complete courses, d) a plain knitted foot with or without terry effect, e) a pocket toe as under c).

The floated pattern consists for example of an insert nine needles wide of three colours, red, blue and green, each only three needles wide. The needles concerned are the needles with the ordinal number 4/5/6, 7/8/9 and 10/11/12 respectively.

The position of the needle control members is shown in the various parts of FIG. 3*a*.

To produce the portion a) the procedure of FIG. 3*a* is used, knitting with a single yarn on all the needles of one feed (the first) and laying in an elastic thread on another feed (the second). This laying-in is effected by 3/1 needle selection, i.e. three consecutive needles are raised in every four to receive the elastic thread whereas the fourth is passed low without being fed with thread or yarn.

Specifically, only the following are allowed to operate:

the cams 18, the fixed cams 19, the counter-cams 20, the actuators 16 and 17 operate normally, the first to raise all the needles and the second to effect a 3/1 selection at the second feed, whereas the actuators 13, 14 and 15 allow the needles to pass low by inactivating their jacks, the required yarn feeds, i.e. the yarn guides 26 with the required yarns, which in practice are the basic yarn and the elastic yarn.

FIG. 3*a'* shows the machine arrangement required to produce the patterned elastic top band. Compared with FIG. 3*a*, the arrangement is modified as follows:

the cams $18_3$, $18_4$ and $18_5$ are withdrawn, the cam 23 is inserted, the feeds for the coloured yarns and transparent yarn are inserted.

In the floated pattern circular knitting machines of the known art, the knitting cams which have to be inactivated are raised axially instead of being withdrawn radially.

This known manner of varying the circular knitting machine configuration is very complicated in that the travel which the various members have to undergo in being inactivated and then returned to operation requires very delicate adjustment. In contrast the use of a radial inactivation system for the cams and the division of the knitting cams into a radially mobile cam 18 and a fixed partial lowering cam 19 which intervenes when the cam 18 is withdrawn makes the circular knitting machine according to the invention of much smoother and more prompt operation and simpler construction.

During cylinder rotation the formation of the knitting courses proceeds as follows.

The elastic thread is fed in the second feed, the red yarn in the third, the blue yarn in the fourth, the green yarn in the fifth and the basic yarn with the transparent yarn in the first. The needles are always selected in 3/1 at the second feed.

The selection is done by the actuators 17.

The elastic thread is laid into the knitted fabric formed by the other yarns.

At the third feed only the needles with the ordinal number 4/5/6 which take the red yarn are raised by the actuator 13, whereas none of the others receive yarn and do not take part in the knitting formation.

Neither do the needles 4/5/6 form knitting because the cam $18_3$ has been withdrawn and they encounter only the next cam 19, which partly lowers them, the needles retaining the yarn and proceeding along their path at an intermediate level, still without forming knitting loops.

At the fourth feed it is the turn of the needles which are required to take up blue yarn. Only the needles with the ordinal number 7/8/9 which take the blue yarn are raised by the actuator 14, whereas none of the others receive yarn, the needles 4/5/6 passing slightly below this feed to proceed on their path while retaining the red yarn. The needles 7/8/9 do not encounter their cam $18_4$ but only their cam 19, which lowers them slightly to level them with the needles 4/5/6.

Knitting continues not to be formed because the needles provided with yarn are not yet lowered to minimum level.

In the same manner, at the fifth feed the needles with ordinal number 10/11/12 are raised to take up the green yarn, and are levelled by the next cam 19 as in the case of the needles 4–9. All the other needles pass from after the second feed to after the fifth feed in the lowered position. Along this section knitting has not been formed, and the red, blue and green yarns carried by the needles 4–12 have merely been taken up and retained.

The needles 4–12 with their coloured yarn are presented to the first ramp raised in the intermediate level, whereas the other needles are presented in the lowered position.

At the actuator 16 all these needles in the lowered position are raised to take up the basic yarn, with the exception of the needles 4–12 which already have their coloured yarn. These latter are raised subsequently by the cam 23 so that, together with all the other needles, they take up the transparent yarn which is presented at the same feed but by a subsequent yarn guide. At the first feed all the needles are lowered to form their course of knitting.

Behind the coloured insert forming the floated pattern there is a bridge of basic yarns giving continuity to the section of patterned knitting and making it stable and resistant. If the pattern has a certain width this bridge can be removed. When working with three-colour floated pattern knitting, only one course of knitting is formed per machine revolution with the basic yarn and the three inserted colours, and the elastic thread remains laid. If only two colours are required there would be space for a further knitting course with the basic yarn, and so on. Those coloured yarns exceeding the patterned part are then cut away and the transparent yarn provides the necessary strength to the patterned part, it therefore not being required in the knitting courses without floated patterns.

At the next machine revolution the procedure is repeated for as long as floated pattern knitting is to be produced. If the pattern consists of vertical stripes the selection of the needles 4–12 remains the same, otherwise the selecting of needles to be raised to take up the coloured yarns is correspondingly changed. When the top band has been completed in accordance with a) or a'), the leg is produced in accordance with b). FIG. 3*b* shows the arrangement of the machine for producing the patterned leg. If insertion of the elastic thread is not required, the second feed is also available to provide basic yarn or a further coloured yarn.

In the second feed, corresponding to a narrower angle, there is space only for three yarn options. The upper portion of the path corresponding to the second feed is brought to the same level as the others by inserting the cam 24. The needle raising cam $21_1$ is inserted to raise all the low needles in cooperation with the actuator 16 to the position in which they receive the basic yarn.

There are various options for producing the leg of the sock. With the machine configuration of FIG. 3*b* the leg can be produced with plain knitting, producing one course of knitting per cylinder revolution, said course being composed of several separate portions of a number of colours equal to the number of feeds, e.g. with five feeds the basic yarn plus a further four colours. The method of forming the pattern with the insertion of the transparent yarn remains as previously described. If instead the leg is required with false ribbing, this can be produced with three pattern colours, the basic yarn plus the elastic yarn laid in similar to the portions a) or a'), by extracting the cam 24. The portions c) and d) are produced with the machine configuration shown in FIG. 3*c*.

The configuration of FIG. 3*c* is also used to produce possible leg portions without patterns.

All the needle control members are made to approach the cylinder with the exception of the cams, 22, which can be brought close to produce a terry effect.

When brought close to the cylinder, the cams 22 cause those needles at the tuck stitch level and at the maximum level to take different descent paths, to bring their respective loops to the two sinker knock-over levels to produce different-length stitches with a terry effect.

To produce the terry effect the sinkers are advanced radially, by a method known in the art.

These portions are worked with simultaneous knitting of a number of plain courses, with or without terry effect, equal to the number of feeds, i.e. five in the case of the illustrated embodiment. Of the knitting courses in the portions c) and e), some are complete whereas others are limited to partial arcs to produce the pocket heel and the toe of the foot.

With the described five-feed configuration it is possible to produce floated pattern sports hosiery in which the patterns can be of three colours or three different yarns plus the basic yarn per course of pattern forming knitting, two feeds beign occupied one by the basic yarn and transparent yarn and the other by the elastic thread, with three feeds therefore available for the pattern yarns.

If less than three colours are used per course to form the pattern, the feeds thus made available can be used for further basic or coloured yarns, to thus form further knitting courses per cylinder revolution.

If four or five pattern colours are required simultaneously in the same knitting course, at least six or seven feeds will therefore be required in the machine. As there are physical limits on the slope of the selection ramps and on the needle movement as a function of the machine rotational speed, such machines with a greater number of feeds must rotate at a lesser speed, and as at least partial compensation for this they form a larger number of knitting courses per cylinder revolution when not producing a pattern. In more general terms the circular knitting machine according to the invention is provided with N feeds, with which sports hosiery can be produced comprising the component parts indicated by a) to e) can be produced, by the following procedure:

the portions a) and a') by knitting one yarn on all the needles in one feed and laying-in an elastic thread on another feed, the plain-knit portion b) by knitting one knitting course per cylinder revolution, said course being composed of several separate portions in N different colours or of false ribbing, with N−1 colours in the same course plus a laid-in elastic thread, it being possible to substitute, for each colour less, one extra course of basic knitting per cylinder revolution, the portions c), d) and e) by simultaneously knitting per cylinder revolution N courses of plain knitting with or without terry effect, some of which in c) and e) are limited to partial arcs.

Basically, in order to better use the available angular space to obtain maximum productivity in those portions without patterns together with the maximum number of workable colours in the same course of patterned portions, during pattern production all the feed stations 26 feed only those knitting cams 18 which have not been radially extracted and are therefore operable, and in the pattern-less portions each feed station 26 feeds its own knitting cam 18.

I claim:

1. A circular knitting machine having a plurality of feed stations and a plurality of needles for forming stitch loops, comprising:

a) knitting cams operatively associated with the machine for lowering the needles to a minimum lower position, wherein said knitting cams are radially moveable with respect to the machine for dissassociating from needle engagement;

b) counter-cams operatively associated with the machine for preventing the needles lowered by said knitting cams from lowering below said minimum lower position;

c) fixed cams operatively associated with the machine for guiding the needles to a predetermined intermediate position; and d) raising cams operatively associated with the machine for raising the needles to a predetermined upper position, wherein said raising cams are radially moveable with respect to the machine for dissociating from needle engagement.

2. The machine of claim 1, wherein said knitting cams are fixed to the machine and said counter-cams are fixed to the machine a predetermined distance apart from said knitting cams.

3. The machine of claim 2, further comprising rising ramps and descent ramps for raising and lowering the needles, respectively, wherein the plurality of feed stations have different angular widths on the machine and said rising ramps and said descent ramps have substantially equal slopes.

4. The machine of claim 3, wherein said rising ramps and said descent ramps have a constant mean slope.

5. The machine of claim 4, further comprising descent cams for lowering the needles to a predetermined position, wherein said descent cams are adapted to move radially with respect to the machine for disassociating from needle engagement.

6. The machine of claim 5, wherein said counter-cams are adapted to move radially with respect to the machine for disassociating from needle engagement.

7. A circular knitting machine having a plurality of feed stations wherein each of the plurality of feed stations have a plurality of needles, and the plurality of needles have needle butts associated therewith, comprising:

a) a plurality of knitting cams operatively associated with the machine for lowering the needles to a minimum lower position, wherein all but one of said plurality of knitting cams are adapted to move radially for disassociating from needle engagement;

b) a plurality of counter-cams operatively associated with said plurality of knitting cams for defining a passage therebetween for the needle butts, wherein said plurality of counter-cams are adapted for preventing the needles lowered by said plurality knitting cams from lowering below said minimum lower position;

c) a plurality of fixed cams associated with said plurality of radially moveable knitting cams for guiding the needles to a predetermined intermediate position; and d) a plurality of raising cams operatively associated with the machine for raising the needles to a predetermined upper position, wherein said plurality of raising cams are adapted to move radially with respect to the machine for disassociating from needle engagement.

8. The machine of claim 7, further comprising raising ramps and descent ramps for raising and lowering the needles, respectively, and needle raising cams for raising the needles to a predetermined level wherein said predetermined level is above said predetermined upper position.

9. The machine of claim 8, further comprising descent cams adapted for lowering the needles from said predetermined upper position and for cooperating with said knitting cams, wherein said descent cams are adapted to move radially with respect to the machine for disassociating from needle engagement.

* * * * *